US009127437B2

(12) United States Patent
Hand et al.

(10) Patent No.: US 9,127,437 B2
(45) Date of Patent: Sep. 8, 2015

(54) FLOW REGENERATION HYDRAULIC CIRCUIT

(75) Inventors: Timothy Hand, Metamora, IL (US); Kevin Bacon, Peoria, IL (US); Victor Wen, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 855 days.

(21) Appl. No.: 13/311,993

(22) Filed: Dec. 6, 2011

(65) Prior Publication Data

US 2012/0152107 A1 Jun. 21, 2012

Related U.S. Application Data

(60) Provisional application No. 61/423,347, filed on Dec. 15, 2010.

(51) Int. Cl.

| | |
|---|---|
| ***F15B 11/08*** | (2006.01) |
| ***E02F 9/22*** | (2006.01) |
| *F15B 11/024* | (2006.01) |

(52) U.S. Cl.

CPC ..... *E02F 9/2217* (2013.01); *F15B 11/024* (2013.01); *F15B 2211/3058* (2013.01); *F15B 2211/3111* (2013.01); *F15B 2211/3127* (2013.01); *F15B 2211/329* (2013.01); *F15B 2211/355* (2013.01); *F15B 2211/40507* (2013.01); *F15B 2211/40584* (2013.01); *F15B 2211/41527* (2013.01); *F15B 2211/6355* (2013.01); *F15B 2211/7053* (2013.01)

(58) Field of Classification Search

CPC ..... F15B 11/024; F15B 2211/7053; F15B 2211/30505; F15B 2211/3058; F15B 21/14; F15B 2011/0246; E02F 9/2285; E02F 9/2235

USPC ..... 91/435, 436, 437, 438; 60/468

See application file for complete search history.

(56) References Cited

U.S. PATENT DOCUMENTS

| | | | | |
|---|---|---|---|---|
| 5,220,862 | A | 6/1993 | Schexnayder | |
| 5,287,794 | A | 2/1994 | Andersson | |
| 5,826,486 | A | 10/1998 | Shimada | |
| 6,161,467 | A | 12/2000 | A'Hearn et al. | |
| 6,786,129 | B2 * | 9/2004 | Ando | 91/318 |
| 7,540,231 | B2 | 6/2009 | Hofmann et al. | |
| 2007/0144164 | A1 | 6/2007 | Hofmann et al. | |
| 2007/0245889 | A1 | 10/2007 | Breunig et al. | |
| 2009/0142201 | A1 | 6/2009 | Lin et al. | |
| 2011/0154816 | A1 * | 6/2011 | Dybing | 60/468 |

FOREIGN PATENT DOCUMENTS

| | | |
|---|---|---|
| DE | 3422978 | 1/1986 |
| EP | 0831181 | 3/1998 |
| JP | 07158607 | 11/2011 |

* cited by examiner

*Primary Examiner* — Edward Look
*Assistant Examiner* — Jason Mikus

(57) ABSTRACT

A hydraulic circuit capable of both a regeneration mode of operation and a full force mode of operation includes a poppet valve controlled by a control valve operating in conjunction with a shuttle valve. The opening of the poppet valve enables the regeneration mode of operation, and the closing of the poppet valve enables the full force mode of operation.

18 Claims, 3 Drawing Sheets

FLOW REGENERATION HYDRAULIC CIRCUIT

RELATED APPLICATIONS

This application is based upon and claims the benefit of priority from U.S. Provisional application No. 61/423,347 by Timothy L. Hand et al., filed Dec. 15, 2010, the contents of which are expressly incorporated herein by reference.

TECHNICAL FIELD

This invention relates generally to a hydraulic circuit, and more specifically to a hydraulic circuit for flow regeneration.

BACKGROUND

In many hydraulic circuits it is desirable to increase the movement speed of an implement by regenerating fluid flow from a discharge side of an actuator to an input side. However, when regenerating flow, the force the actuator is capable of producing may be lessened in exchange for the increased velocity. Accordingly, it may be beneficial to provide a hydraulic system capable of effectively switching between a regeneration state and a full force state.

SUMMARY OF THE DISCLOSURE

A hydraulic system is disclosed having an actuator with a first fluid chamber and a second fluid chamber; a poppet valve having an open position and a closed position, the poppet valve including a pressure chamber defined in part by a first working surface biasing the poppet valve toward the closed position; a shuttle valve in fluid communication with the first and second fluid chambers, the shuttle valve being configured to selectively pass fluid from the fluid chamber having a higher pressure; and a control valve movable between a first position facilitating fluid communication between the pressure chamber and the fluid selectively passed by the shuttle valve, and a second position facilitating fluid communication between the pressure chamber and the first fluid chamber.

In another embodiment of the disclosure, a hydraulic system is disclosed having an actuator with a first fluid chamber and a second fluid chamber; a poppet valve having an open and a closed position, the poppet valve including a pressure chamber biasing the poppet valve toward the closed position, and having a first port and a second port, wherein the first and second ports of the poppet valve are substantially fluidly isolated when the poppet valve is shut, and wherein the first and second ports of the poppet valve are in fluid communication when the poppet valve is open; a shuttle valve having a first port, a second port, and a third port, wherein the shuttle valve selectively communicates either the first port of the shuttle valve or the second port of the shuttle valve, whichever is at a higher pressure, with the third port of the shuttle valve; a first passage fluidly connecting the first fluid chamber, the first port of the shuttle valve, and the first port of the poppet valve; a second passage fluidly connecting the second fluid chamber, the second port of the shuttle valve, and the second port of the poppet valve; and a control valve having a first position facilitating fluid communication between the pressure chamber and the third port of the shuttle valve, and a second position facilitating fluid communication between the pressure chamber and the first passage.

DETAILED DESCRIPTION

Figure 1:
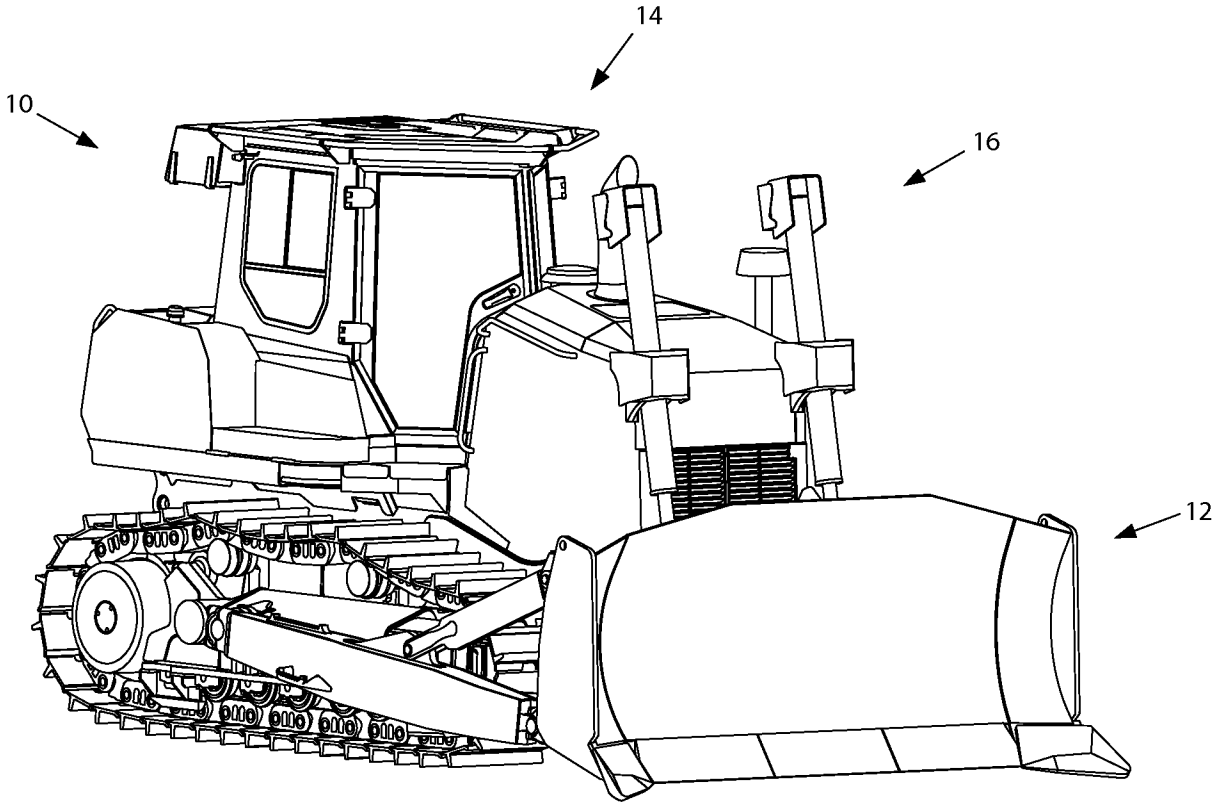
FIG. 1 illustrates a machine having an implement.

FIG. 1 illustrates a machine 10 having an implement 12 and a body 14. In the illustrated embodiment, machine 10 is a bulldozer; however, machine 10 may also be a wheel loader, motor grader, truck, excavator, scraper, or any other machine to which this disclosure may relate. Machine 10 also includes an actuator 16 configured to move the implement 12. It is contemplated that a plurality of actuators may be working to working together to achieve the same functionality without departing from the scope of this disclosure. As illustrated in FIG. 1, actuator 16 is configured to move implement 12 relative to body 14 in a generally vertical motion; however, in alternate embodiments actuator 16 may cause implement 12 to move horizontally, to rotate, or to move in any other way known in the art. In the illustrated embodiment, implement 12 is a blade; however, implement may alternately be a bucket, a shovel, a bed, or other tool.

Figure 2:
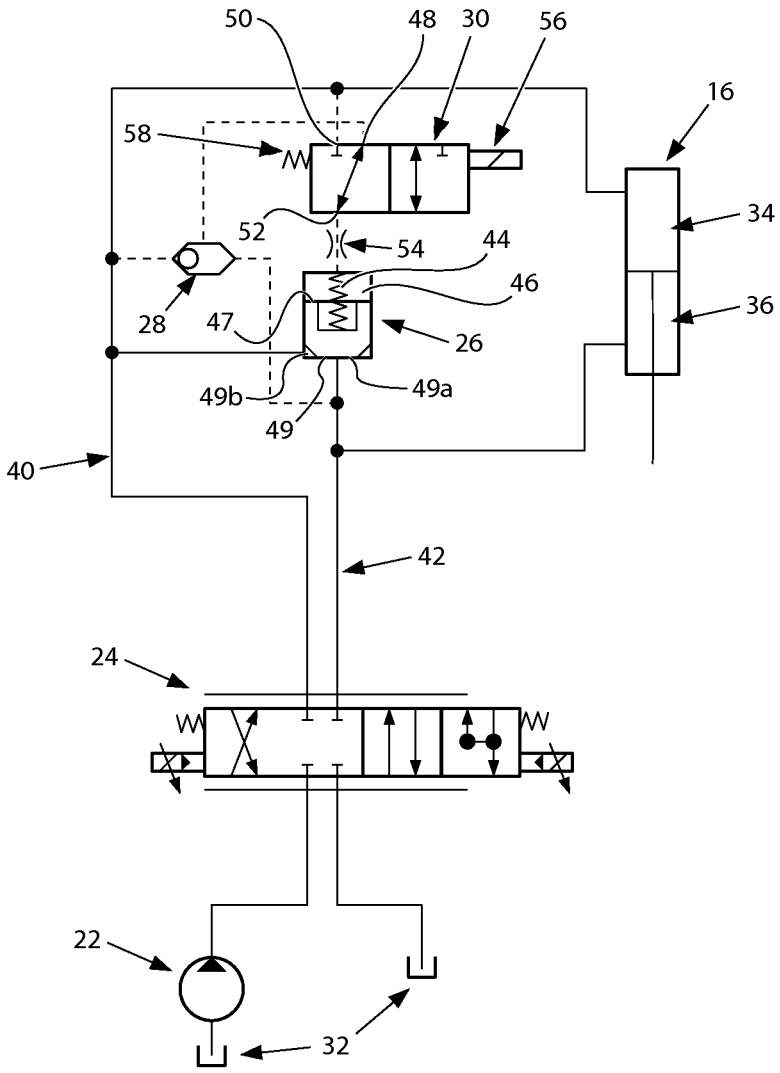
FIG. 2 illustrates a first embodiment of a hydraulic circuit for control of the implement.

FIG. 2 illustrates a first embodiment of a hydraulic circuit 20 to control fluid flow in and out of actuator 16. Hydraulic circuit 20 includes a source 22 of pressurized hydraulic fluid, a first control valve 24, a poppet valve 26, a shuttle valve 28, and a second control valve 30, and a low pressure reservoir 32. As further illustrated in FIG. 2, actuator 16 includes a head end fluid chamber 34 and a rod end fluid chamber 36.

In the first embodiment, a head conduit 40 fluidly connects the head end fluid chamber 34 to a port of the first control valve 24. Similarly, a rod conduit 42 fluidly connects the rod end fluid chamber 36 to another port of the first control valve 24. As illustrated, the first control valve 24 selectively fluidly connects the head conduit 40 and the rod conduit 42 with the source 22 and the reservoir 32, selectively causing the actuator 16 to extend, retract, float, or substantially hold its position.

According to the illustrated embodiment, the poppet valve 26 is disposed between the head conduit 40 and the rod conduit 42 such that when the poppet valve 26 is open fluid is capable of passing between the head conduit 40 and the rod conduit 42 via the poppet valve 26, thereby facilitating fluid communication between the head end fluid chamber 34 and the rod end fluid chamber 36. Conversely, when the poppet valve 26 is closed fluid is substantially prevented from passing between the head conduit 40 and the rod conduit 42 via the poppet valve 26. In the illustrated embodiment, the poppet valve 26 is biased toward an open position by pressure in the head conduit 40 and pressure in the rod conduit 42; conversely, the poppet valve 26 is biased toward a closed position by a spring 44 and fluid in a pressure chamber 46. As illustrated in FIG. 2, the pressure chamber 46 is defined, in part, by a first working surface 47. Fluid pressure acting on the first working surface 47 tends to bias the poppet valve 26 toward the closed position. The poppet valve 26 also includes a second working surface 49. Fluid pressure acting on the second working surface 49 tends to bias the poppet valve 26 toward the open position. According to the illustrated embodiment, the second working surface 49 includes a first portion 49*a* in fluid communication with the rod end fluid chamber 36 by way of the rod conduit 42, and a second portion 49*b* in fluid communication with the head end fluid chamber 34 by way of the head conduit 40.

With further reference to FIG. 2, the shuttle valve 28 is connected between the head conduit 40, the rod conduit 42, and a first port 48 of the second control valve 30. The shuttle valve 28 is configured such that a pressure signal from either the head conduit 40 or the rod conduit 42, whichever is at a higher pressure, is passed to the first port 48. A second port 50 of the second control valve 30 is in fluid communication with the head conduit 40. A third port 52 of the second control valve 30 is in fluid communication with the pressure chamber 46 of the poppet valve 26. An orifice 54 may be provided between the pressure chamber 46 and the third port 52 to dampen movement of the poppet valve 26.

The second control valve 30 has a first position in which the first port 48 is in fluid communication with the third port 52, whereby the pressure chamber 46 is in fluid communication with the shuttle valve 28. The second control valve 30 has a second position in which the second port 50 is in fluid communication with the third port 52, whereby the pressure chamber 46 is in fluid communication with the head conduit 40. In the illustrated embodiment, the second control valve 30 is biased toward the first position by a spring 58, and the second control valve 30 is biased toward the second position by a solenoid 56.

Figure 3:
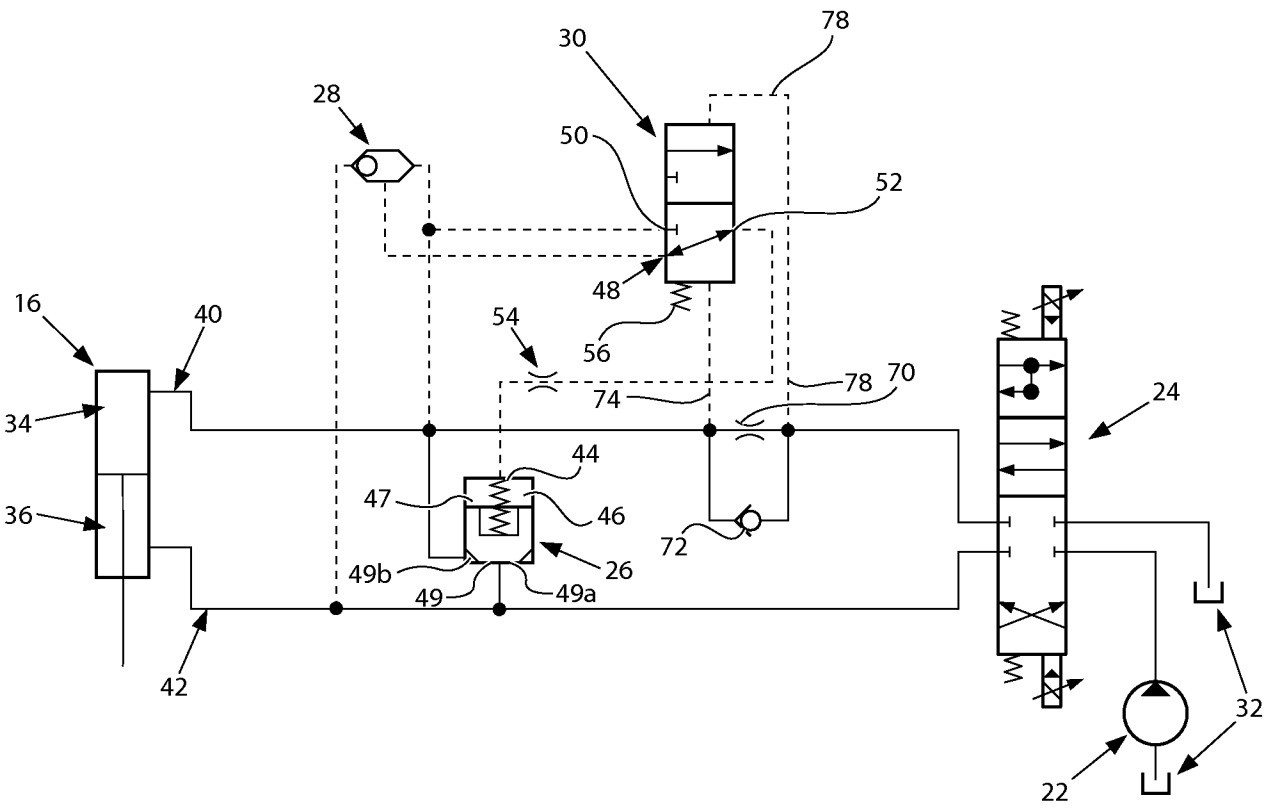
FIG. 3 illustrates a second embodiment of a hydraulic circuit for control of the implement.

FIG. 3 illustrates a second embodiment of the hydraulic circuit 20 that is similar in configuration to the first embodiment, with a distinction in the manner in which the second control valve 30 is actuated. As illustrated in FIG. 3, a throttling orifice 70 is provided in the head conduit 40 in parallel with a check valve 72. The check valve 72 is oriented such that fluid flow out of the head end fluid chamber 34 can pass through the check valve 72, whereas fluid flow into the head end fluid chamber 34 can not pass through the check valve 72 and is channeled through the throttling orifice 70.

A first pilot line 74 is connected to the head conduit 40 between the throttling orifice 70 and the head end fluid chamber 34. A second pilot line 78 is connected to the head conduit 40 between the throttling orifice 70 and the first control valve 24. The first pilot line 74 provides pressurized fluid to the second control valve 30 and biases the second control valve 30 towards the first position. In a similar manner, the second pilot line 78 provides pressurized fluid to the second control valve 30 and biases the second control valve 30 towards the second position. Similar to the embodiment illustrated in FIG. 2, a spring 56 also biases the second control valve 30 toward the first position.

Accordingly, as flow through the head conduit 40 toward the head end fluid chamber 34 increases, a pressure drop across the throttling orifice 70 increases, and thus the net force biasing the second control valve 30 toward the second position increases. Once this net force is sufficient to overcome the force of the spring 56, the second control valve 30 will shift to the second position.

INDUSTRIAL APPLICABILITY

With respect to FIGS. 1 and 2, when it is desirable to lower the implement 12, the first control valve 24 may be actuated to connect rod conduit 42 with the low pressure reservoir 32 and the head conduit 40 with the source of hydraulic fluid 22. When it is desirable to operate the actuator 16 in a full force mode, such as when digging, the solenoid 56 in the illustrated configuration may be disengaged. With the solenoid 56 disengaged the spring 58 will tend to bias the second control valve 30 toward a position in which the pressure chamber 46 is connected with the shuttle valve 28. In this manner the poppet valve 26 will tend to remain closed because the pressure chamber 46 will be connected to whichever of the head conduit 40 or the rod conduit 42 is at a higher pressure. The area of surface 47 is greater than that of surface 49, so if the pressure in chamber 46 is equal to that in rod conduit 42, poppet valve 26 will still remain closed. As the poppet valve 26 under these conditions will tend to prevent fluid from passing between the head end fluid chamber 34 and the rod end fluid chamber 36, the actuator 16 is capable of operating at its full potential force.

Conversely, when it is desirable to operate the actuator 16 in a quick drop or regenerative mode, such as to rapidly lower the implement 12 from a raised position, the solenoid 56 in the illustrated configuration may be engaged, thereby connecting the pressure chamber 46 with the head conduit 40. In this manner, when the head end fluid chamber 34 is at a lower pressure than the rod end fluid chamber 36, such as when the implement 12 is raised and gravity or external force is acting to extend the actuator 16, the lower pressure in the pressure chamber 46 may allow the poppet valve 26 to open, and allow fluid from the rod end fluid chamber 36 to flow into the head end fluid chamber 34. In this manner, the speed of the actuation of the actuator 16 may be increased because it is not limited by the flow of hydraulic fluid provided from the source of hydraulic fluid 22 or by flow through first control valve 24.

When external force, such as, for example, gravity, is countered or reduced significantly, for example, when the implement 12 hits the ground, fluid chamber 36 pressure decreases, actuator 16 extension speed slows down or comes to a stop, while at the same time, pump flow still reaches the fluid chamber 34 and boosts up the pressure, hence the pressure in poppet chamber 46 increases accordingly. Once the latter becomes high enough so that the force it exerts on area 47 is able to overcome the force on area 49 of the poppet valve 26, which connects to chamber 36 with decreased pressure, the poppet valve 26 closes up. As a result, the regeneration path is cut off and the actuator 16 extends with full hydraulic force mode. This transition is done automatically without additional command.

The embodiment illustrated in FIG. 3 may operate in a manner similar to the embodiment illustrated in FIG. 2, except that a pressure differential over a throttling orifice 70 is used to actuate the second control valve 30 rather than a solenoid 56. According to this embodiment, when fluid the implement 12 is being raised, fluid may flow out of the head end fluid chamber 34 through a check valve 72 so that the flow out of the head end fluid chamber 34 is not restricted by the throttling orifice 70.

When the implement 12 is being lowered and fluid is flowing into the head end fluid chamber 34, the fluid is channeled through the throttling orifice 70, and the pressure differential over the throttling orifice 70 increases with the flow rate of fluid through the orifice. Accordingly, when the rate of fluid flow into the head end fluid chamber 34 is sufficiently low, the spring 56 will overcome the pressure imbalance between the first pilot line 74 and the second pilot line 78, causing the pressure chamber 46 to be in fluid communication with the shuttle valve 28, which will tend to keep the poppet valve 26 shut in a manner similar to the embodiment described above and illustrated in FIG. 2. Once the flow into the head end fluid chamber 34 reaches a flow rate that creates a pressure differential between the first pilot line 74 and the second pilot line 78 sufficient to overcome the force of the spring 56, the second control valve 30 will shift positions such that the pressure chamber 46 is in fluid communication with the head conduit 40, which will tend to allow the poppet valve 26 to open when the head end fluid chamber 34 is at a lower pressure than the rod end fluid chamber 36. In this manner, the implement 12 may quickly be lowered from a raised position, while still allowing the implement 12 to operate with full force for operations such as digging.

It will be apparent to those skilled in the art that various modifications and variations can be made to the disclosed invention without departing from the scope or spirit of the invention. Additionally, other embodiments of the disclosed invention will be apparent to those skilled in the art from consideration of the specification and practice of the apparatus and method disclosed herein. It is intended that the specification and examples be considered as exemplary only.

What is claimed is:

1. A hydraulic system comprising, an actuator having a first fluid chamber and a second fluid chamber;

a poppet valve having an open position and a closed position, the poppet valve including a pressure chamber defined in part by a first working surface biasing the poppet valve toward the closed position;

a shuttle valve in fluid communication with the first and second fluid chambers, the shuttle valve being configured to selectively pass fluid from the fluid chamber having a higher pressure; and a control valve movable between a first position facilitating fluid communication between the pressure chamber and the fluid selectively passed by the shuttle valve, and a second position facilitating fluid communication between the pressure chamber and the first fluid chamber, the control valve biased towards the first position by fluid in a second pilot line and biased towards the second position by fluid in a first pilot line.

2. The hydraulic system of claim 1, wherein the open position of the poppet valve facilitates fluid communication between the first fluid chamber and the second fluid chamber.

3. The hydraulic system of claim 2, wherein the closed position of the poppet valve restricts fluid communication between the first fluid chamber and the second fluid chamber.

4. The hydraulic system of claim 3, wherein the poppet valve has a second working surface having a first portion in communication with fluid in the second fluid chamber.

5. The hydraulic system of claim 4, wherein the second working surface biases the poppet valve toward the open position.

6. The hydraulic system of claim 5, wherein the second working surface has a second portion in communication with fluid in the first fluid chamber.

7. The hydraulic system of claim 1, wherein a spring biases the poppet valve toward the closed position.

8. The hydraulic system of claim 1, wherein the control valve is selectively moved between the first position and the second position by a solenoid.

9. The hydraulic system of claim 8, wherein the control valve is biased toward the second position by the solenoid.

10. The hydraulic system of claim 9, wherein the control valve is biased toward the first position by a spring.

11. The hydraulic system of claim 1, wherein the control valve is actuated by fluid in a first pilot line.

12. The hydraulic system of claim 1, further comprising a source of hydraulic fluid and a throttling orifice, wherein the second pilot line is fluidly connected between the source and the throttling orifice.

13. The hydraulic system of claim 1, wherein the first pilot line is fluidly connected between the throttling orifice and the first fluid chamber.

14. The hydraulic system of claim 13, further comprising a check valve in parallel with the throttling orifice, the check valve being configured to pass fluid flowing from the first fluid chamber and restrict fluid flowing to the first fluid chamber.

15. A hydraulic system comprising, an actuator having a first fluid chamber and a second fluid chamber;

a poppet valve having an open and a closed position, the poppet valve including a pressure chamber biasing the poppet valve toward the closed position, and having a first port and a second port, wherein the first and second ports of the poppet valve are substantially fluidly isolated when the poppet valve is shut, and wherein the first and second ports of the poppet valve are in fluid communication when the poppet valve is open;

a shuttle valve having a first port, a second port, and a third port, wherein the shuttle valve selectively communicates either the first port of the shuttle valve or the second port of the shuttle valve, whichever is at a higher pressure, with the third port of the shuttle valve;

a first passage fluidly connecting the first fluid chamber, the first port of the shuttle valve, and the first port of the poppet valve;

a second passage fluidly connecting the second fluid chamber, the second port of the shuttle valve, and the second port of the poppet valve; and a control valve having a first position facilitating fluid communication between the pressure chamber and the third port of the shuttle valve, and a second position facilitating fluid communication between the pressure chamber and the first passage.

16. The hydraulic system of claim 15, wherein the poppet valve has a working surface biasing the poppet valve toward an open position, and wherein the working surface has a first portion in communication with fluid in the second passage.

17. The hydraulic system of claim 16, wherein the working surface has a second portion in communication with fluid in the first passage.

18. A machine comprising, a work tool;

an actuator having a first fluid chamber and a second fluid chamber, the actuator configured to actuate the work tool; and a hydraulic system including:

a poppet valve having an open and a closed position, the poppet valve including a pressure chamber defined in part by a first working surface biasing the poppet valve toward the closed position;

a shuttle valve in fluid communication with the first and second fluid chambers, the shuttle valve being configured to selectively pass fluid from the pressure chamber having a higher pressure; and a control valve movable between a first position facilitating fluid communication between the pressure chamber and the fluid selectively passed by the shuttle valve, and a second position facilitating fluid communication between the pressure chamber and the first fluid chamber, the control valve biased towards the first position by fluid in a second pilot line and biased towards the second position by fluid in a first pilot line.

* * * * *